United States Patent [19]

Kitzberger

[11] Patent Number: 5,076,551

[45] Date of Patent: Dec. 31, 1991

[54] FLUSHING ARRANGEMENT FOR A METALLURGICAL VESSEL

[75] Inventor: Reinhard Kitzberger, Gallneukirchen, Austria

[73] Assignee: Voest-Alpine Industrieanlagenbau G.m.b.H, Linz, Austria

[21] Appl. No.: 533,177

[22] Filed: May 31, 1990

[30] Foreign Application Priority Data

Jun. 13, 1989 [DE] Fed. Rep. of Germany ..... 3919238

[51] Int. Cl.[5] ..... C21C 7/00

[52] U.S. Cl. ..... 266/217; 266/270

[58] Field of Search ..... 266/217, 218, 265, 270

[56] References Cited

U.S. PATENT DOCUMENTS

| | | | |
|---|---|---|---|
| 4,462,824 | 7/1984 | Nauman | 266/218 |
| 4,735,400 | 4/1988 | Tate et al. | 266/270 |
| 4,744,546 | 5/1988 | Graf | 266/218 |
| 4,768,756 | 9/1988 | Butter et al. | 266/218 |
| 4,930,757 | 6/1990 | Manwell et al. | 266/218 |

FOREIGN PATENT DOCUMENTS

| | | |
|---|---|---|
| 265341 | 10/1968 | Austria . |
| 043338 | 1/1982 | Fed. Rep. of Germany . |
| 043787 | 1/1982 | Fed. Rep. of Germany . |
| 021861 | 1/1981 | France . |
| 032350 | 8/1981 | France . |
| 053554 | 6/1982 | France . |
| 064449 | 11/1982 | France . |

OTHER PUBLICATIONS

Publication: Radex-Rundschau, No. 3, 12/1981, pp. 499-551.

*Primary Examiner*—S. Kastler

*Attorney, Agent, or Firm*—Hopgood, Calimafde, Kalil, Blaustein & Judlowe

[57] ABSTRACT

A flushing arrangement for a metallurgical vessel, in particular for a steelworks converter, includes a refractory lining constituting the working lining and pipes provided on predetermnined sites of the refractory lining, through which flush gas flows. In order to prevent the pipes from getting jammed and to obtain a strongly bundled gas jet, at least one bar-shaped insert extending in the longitudinal direction of the pipe is provided centrally in each pipe, forming an annular gap with the inner wall of the pipe.

29 Claims, 2 Drawing Sheets

FLUSHING ARRANGEMENT FOR A METALLURGICAL VESSEL

The invention relates to a flushing arrangement for a metallurgical vessel, in particular for a steelworks converter, comprising a refractory lining constituting the working lining and pipes provided on predetermined sites of the refractory lining, through which flush gas flows.

By blowing flush gas into a metal melt, for instance through the bottom of a metallurgical vessel, a stirring effect may be obtained within the metal melt, thus balancing out disequilibriums of composition and temperature, causing the separation of non-metallic inclusions and promoting the degassing of the metal melt to a certain extent.

A variety of means are known for injecting flush gas. Thus, for instance, Radex-Rundschau, No. 3, 1981, pp. 499 to 517; EP-A-0 053 554 and EP-A-0 032 350 show gas-permeable refractory converter flushing bricks as known, such a gas flushing brick being inserted instead of a brick of the refactory lining of the converter. The flushing brick, which has a sheet case including a porous refractory mass to prevent the lateral exit of gas, thus substitutes a conventional brick of the working lining of the converter, wherein the porous mass may be provided with a directed porosity. The sheet case is open towards the converter interior, while on the opposite end of the flushing brick, on which the sheet case is closed, a feed line is connected to the sheet case in a gas-tight manner. Flushing bricks of this type have the disadvantage that they are complex to produce and install and that between the sheet case and the porous refractory mass contained therein an uncontrolled gas penetration may occur in case the refractory mass does not completely contact the sheet case. Furthermore, such a flushing brick is more rapidly worn than the working lining of the converter so that material and time consuming measures of repair are necessary between two relinings of the working lining.

Moreover, it is known (AT-B-265 341) to embed a tuyere pipe in a refractory flushing brick, which, however, involves the disadvantage that the flushing brick likewisely inserted instead of a conventional brick of the refractory lining of the converter always must be provided with a certain minimum amount of flush gas as long as the flushing brick is covered with melt in order to prevent the tyuere pipe from getting obstructed by intruding melt.

It is, furthermore, known (EP-A-0 043 338, EP-A-0 021 861 and EP-A-0 043 787) to form a flushing brick of several refractory piece parts having a low porosity or none at all, wherein the piece parts are held together by the sheet case to form what is called a sandwich plug, which likewisely is incorporated in the refractory lining of the converter instead of a conventional brick. In the abutting surfaces of the refractory piece parts, longitudinal grooves or grooved metal inserts are provided, which form cavities conducting the flush-gas. In addition to the fact that such a sandwich plug also is very complex and cumbersome to produce, it has the disadvantage that the gas permeability may change during the service life if a piece part severs from the neighboring piece part or from the sheet case. Moreover, premature wear may not be excluded, because the refractory piece parts have a composition other than the refractory bricks of the working lining.

In order to avoid these disadvantages, it is known (EP-A-0 155 255) to install a metallic flush plate on predetermined sites of the bottom between neighboring refractory bricks, which extends between the flushing bricks from one transverse joint to the other. This may involve a relatively high wear of the bricks provided at the joints comprising the flush plate. Due to the expansion of a brick during heating of the metallurgical vessel, squeezing and, thus, a reduction of the flush-gas rate may occur.

From EP-B-0 064 449 a flushing means of the initially defined kind is known, in which several flattened pipes departing from a distributor located outside of the vessel are led through the converter shell and the permanent lining and are inserted in recesses cut into neighboring bricks of the working lining. The flattened pipes have the effect that no melt will penetrate the outlets of the pipes, solidifying there and obstructing the same such that blowing free is no longer possible. However, the flattened pipes have the disadvantage that the pipe is subject to strong deformations (bulging, rippling) on account of the slight wall thickness and the large width. As a result, the pipe gets jammed in the brickwork, its movability being restricted, and the pipe will be torn off or will burst within the brickwork at a relative displacement between the permanent lining and the working lining. This is favored by the fact that the thin-wall pipe loses its toughness during operation due to carburization. Hence follows a relatively large wear of the bricks in the joint regions comprising the flattened pipes, which affects the life of the working lining in the region of a damaged pipe and calls for premature renewal of the brickwork of the vessel.

An additional disadvantage of flattened pipes is to be seen in that supplied gas enters the vessel interior relatively widely spread, thus negatively influencing the flushing effect.

The invention aims at avoiding these disadvantages and difficulties and has as its object to provide a flushing means of the initially defined kind, with which the gas jet enters the vessel interior in a most strongly bundled manner, yet prevents melt from penetrating the pipes even at a low gas pressure, and with which as few differences in the operational conditions as possible, in particular, in terms of shape, axial movability and outlet cross section, occur between the refractory lining and the pipes.

In accordance with the invention, this object is achieved in that at least one bar-shaped insert extending in the longitudinal direction of the pipe is provided centrally in each pipe, forming an annular gap with the inner wall of the pipe.

It is known from EP-B-0 064 449 to incoporate one or several wires in flattened pipes, that project through the working lining in the longitudinal direction of the pipes and which wires have diameters corresponding to the width of the internal cross section of the pipe. It is the task of the wire(s) to prevent the flattened pipes from getting additonally squeezed. Thus, the wire constitutes a subdivision of the pipe's internal cross section into two or more internal spaces.

Preferably, the part of the pipe located within the working lining and the insert(s) inserted therein are designed to be radially symmetrical, thermal expansions, thus, being uniformly distributed over the cross section such that the stress due to the working lining caused thereby will be distributed evenly over the periphery of the pipe.

An embodiment to be produced in a simple way is characterized in that the pipe has a circular cross section.

A particularly snug.fit in the recesses cut into the bricks of the working lining to receive the pipes results if the pipe has a cross section formed by a regular polygon, preferably has a square or a hexagonal cross section.

According to a preferred embodiment, the insert is formed by a wire or a wire rope. It is also possible to form the insert by an internal pipe, through which oxygen may be conducted, if desired.

Preferably, the insert in the part of the pipe located within the working lining is arranged in a loose manner, i.e., without lateral support, and is fixed in its position relative to the pipe in the axial direction only. As gas passes the pipe, the insert automatically is centered within the pipe such that there will always be an annular gap between the pipe inner wall and the insert during gas flushing.

A preferred embodiment is characterised in that there is a slight play provided in the axial direction relative to the pipe by the fixation of the insert. Thereby, the insert may slightly move in the axial direction relative to the pipe, which impedes the obstruction of the pipe even at extreme operational conditions (e.g., at a very low flush gas rate).

Preferably, the annular gap has a width of between 1 and 3 mm, the internal diameter of the pipe suitably ranging between 4 and 12 mm, preferably between 4 and 8 mm, the diameter of the insert being 2 to 8 mm, preferably 2 to 5 mm.

Since pipes made of steel are subject to strong embrittlement due to carburization, sufficient strength of the pipe suitably will be ensured if the pipe has a wall thickness that corresponds approximately to half the internal diameter of the pipe.

Advantageously, the ratio of the length of the pipe located within the working lining to the internal diameter of the pipe located within the working lining is at least 16, that is at least 16 to 1, which ratio should be present not only in newly bricked converters, but even at the end of a converter campaign, i.e., when the converter is to be newly bricked.

A preferred embodiment simply to produce is characterized in that at least two pipes arranged at a distance from each other within the working lining of the metallurgical vessel are connected in a duct-like manner with a common gas feeding pipe by their ends located outside of the working lining, the insert of each pipe being fastened to the gas feeding pipe.

Another preferred embodiment, the manufacture of which also is particularly simple, is characterized in that two pipes arranged at a distance from each other within the working lining of the metallurgical vessel are connected in a duct-like manner to a common gas feeding pipe by their ends located outside of the working lining and that the two pipes have a common insert extending from the mouth of one pipe as far as to the mouth of another pipe.

In order to ensure as perfectly as possible the centering of the insert relative to the pipe in the radial direction, the insert suitably is immobilized in the axial direction on the part of the pipe located outside of the working lining.

In this case, the insert suitably may be fastened to the pipe by means of a supporting rib.

With large pipe diameters, the pipe advantageously comprises a plurality of inserts.

In order to ensure a certain movability of the insert relative to the pipe, the pipe advantageously includes a straight pipe portion extending at an angle to the pipe portion located within the working lining and passed by the insert.

Suitably, the volumes that remain clear between the pipe and a working lining formed by refractory bricks are filled with refractory mass.

BRIEF DESCRIPTION OF DRAWINGS

The invention will be explained in more detail by way of several exemplary embodiments and with reference to the accompanying drawing, wherein.

Figure 1:
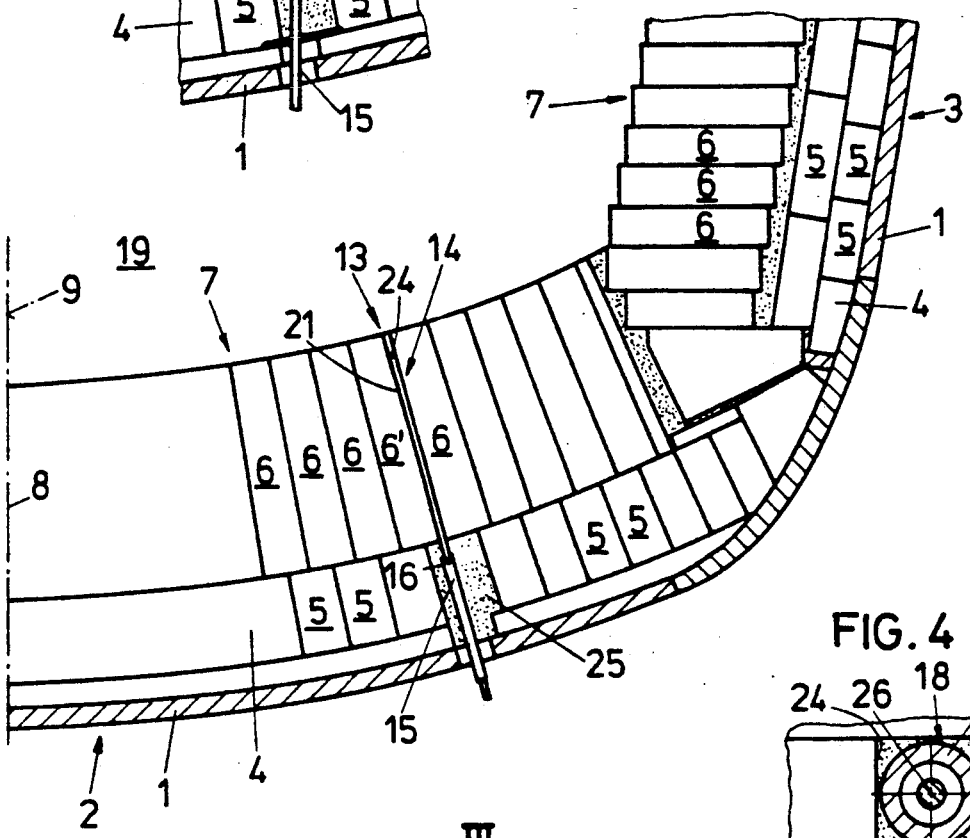
FIG. 1 is a longitudinal section through a steelworks converter.
Figure 4:
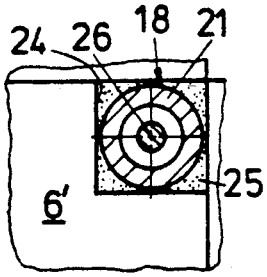
FIG. 4 depicts a detail of FIG. 2 on an enlarged scale.
Figure 2:
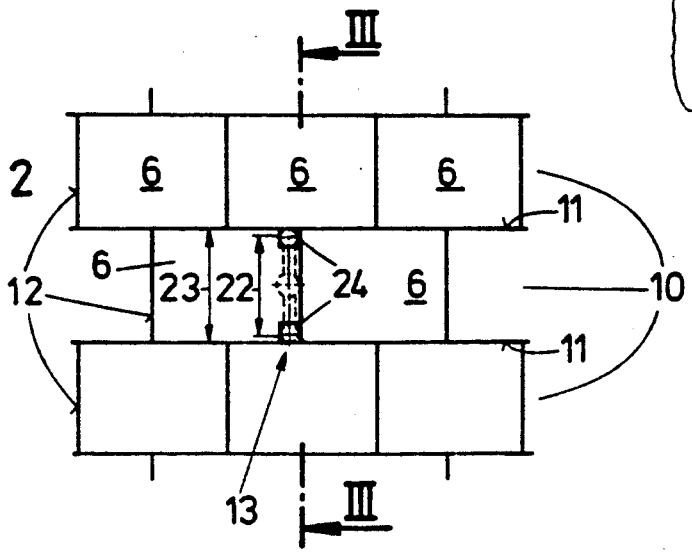
FIG. 2 is a top view on the bottom of the steelworks converter.

The steelworks converter represented in FIG. 1 has a metal outer shell 1, which is provided with a permanent lining 4 on its internal side, both on the bottom 2 and on its side walls 3. On the permanent lining, which is made of refractory bricks 5, a working lining 7 also made of refractory bricks 6 is applied. As is apparent from FIG. 2, the refractory bricks 6 of the working lining 7 are arranged in rows 10 departing radially from the center 8 of the bottom 2, or from the longitudinal axis 9 of the converter, wherein parallel rows 10 lie adjacent each other via longitudinal joints 11 and the bricks 6 of adjacent rows 10 are offset relative to each other. The abutting bricks 6 of each row form transverse joints 12 verging into the longitudinal joints 11 formed between adjacent rows 10, each ending in a side face of a brick of an adjacent row 10.

Flushing means 14 are inserted on predetermined sites 13 of the bottom 2, which preferably are provided at approximately equal distances from the center 8 of the bottom 2 and also at equal distances from one another. According to the embodiment illustrated in FIGS. 1 to 4, each flushing means 14 is comprised of a flush gas feeding pipe 15 penetrating the metal outer shell 1 and extending as far as to a level closely below the working lining 7.

On the end 16 of the feeding pipe 15, which is closed on its front side, two pipes 18 welded into the jacket 17 of the feeding pipe and subsequently called distributing pipes are arranged, which have circular cross sections and diverge from the end 16 of the feeding pipe 15 in the direction towards the converter interior 19 in the form of a U-shaped arc portion 20 designed like a fork. These arc portions 20 of the distributing pipes 18 are located in the permanent lining 4 closely below the working lining 7. The arc portions 20 pass into straight pipe portions 21 having circular cross sections, whose distance 22 approximately corresponds to the thickness 23 of a brick 6 of the working lining 7. One 6' of the bricks 6 of the working lining 7 has recesses 24 provided on its corners, which, in terms of cross section, are designed to correspond to the cross section of the pipe portions 21 in order to receive these pipe portions 21. The interspace between the pipe sections 21 and the brick 6' is filled with refractory mass 25.

Bar-shaped inserts 26 formed by wires are provided within the distributing pipes 18, extending over the entire length of the distributing pipes 18 and projecting into the feeding pipe 15. The ends 27 of the inserts 26 projecting into the feeding pipe 15 are bent at right angles and are fastened, e.g., are welded, to a plate 28 closing the feeding pipe 15 on its front end. Thereby, the inserts 26 are immobilized in the axial direction with respect to the distributing pipes 18. In the radial direction, the inserts are freely movable relative to the distributing pipes 18, i.e., relative to their straight pipe portions 21 penetrating the working lining 7. This movability is due to deformations occurring in the elastic regions of the inserts 26. As gas passes, the inserts 26 automatically are centered with respect to the internal wall 29 of the distributing pipes 18 such that an annular gap 30 of uniform width forms between each insert 26 and the internal wall 29 of the distributing pipe 18. The internal diameter of the distributing pipes is 6 mm, the diameter of the inserts is 3 mm.

Figure 5:
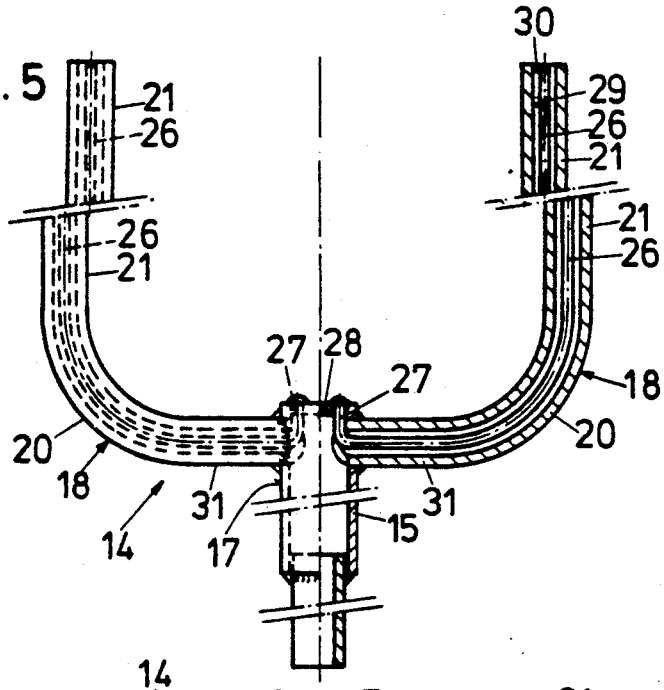
FIG. 5 illustrates a flushing means in the side view, partially sectioned.

As is apparent from FIG. 5, the distributing pipes comprise a straight piece 31 between the feeding pipe 15 and their arc portion 20, which allows for a certain radial movability of the insert 26 relative to this straight piece 31. This radial movability, in the straight pipe portion 21 extending approximately at a right angle to the straight piece 31, provides for a slight axial movability of the insert 26 relative to the pipe portion 21, thus reliably preventing the annular gap 30 from getting obstructed on the free end of the pipe portion 21 even if only very slight gas amounts are blown into the converter interior through the distributing pipes 18.

On account of the radially symmetric configuration of the annular gap 30, the kinetic energy of the gas jet can be introduced into the melt in a strongly bundled manner, the gas jet, thus, being influenced by the melt to a minor extent only. Moreover, the closing up of the annular gap 30 is largely prevented thereby.

Due to the straight pieces 31 of the distributing pipes 18 branching off the feeding pipe 15, a relative movement between the permanent lining 4 and the working lining 7 may well be absorbed such that breaking off of the distributing pipes 18 will be prevented. Advantageously, this straight piece 31 is covered by a soft or dampening material, thus forming a free space for accommodating the relative movements resulting between the permanent lining 4 and the working lining 7.

Figure 3:
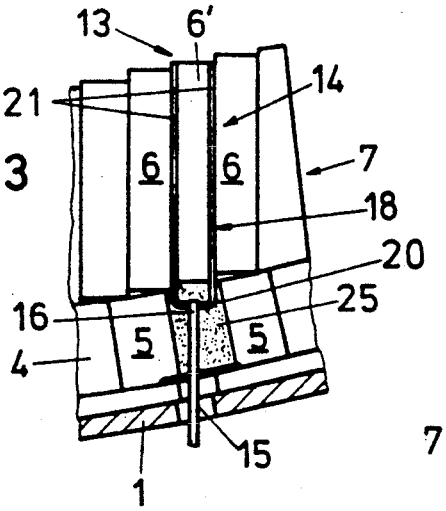
FIG. 3 is a section along line III—III of FIG. 2 according to a first embodiment.

As is apparent from FIGS. 1 and 3, only a slight portion of the volume of the permanent lining 4 is penetrated by the flushing means 14 such that only a slight amount of ramming mass 25 is required to replace a brick 5 of the permanent lining 4 on the site of introduction of the feeding pipe 15.

Figure 7:
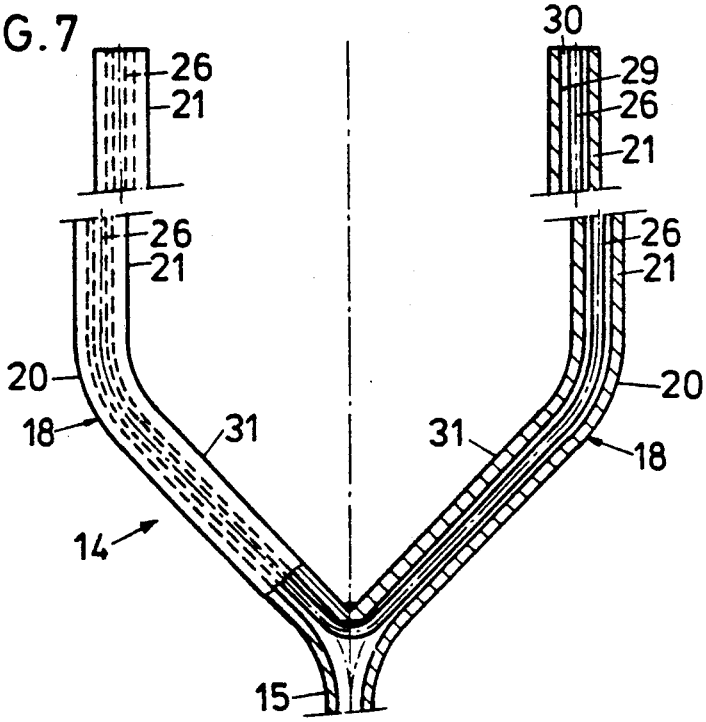
FIG. 7 represents another embodiment of the flushing means in an illustration analogous to FIG. 5.
Figure 10:
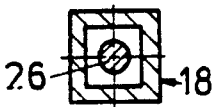
FIGS. 10 to 13 depict various cross sectional shapes of pipes and inserts.
Figure 11:
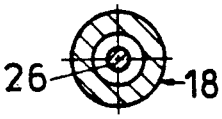
Figure 12:
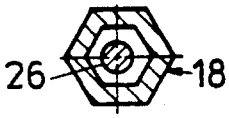
Figure 13:
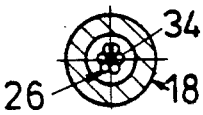

According to the embodiment represented in FIG. 7, the insert 26 also is bent in a U-shaped manner and, with fork-shaped distributing pipes 18, reaches from the mouth of one distributing pipe 18 to the mouth of the opposite, second pipe 18, via the junction site of the feeding pipe 15. Thereby, the insert 26 is fixed in the axial direction to such an extent that it cannot be pressed out of the distributing pipes. Hence also results a good slight movability in the axial direction relative to the straight pipe portions 21 so as to again prevent the penetration of melt into the distributing pipes and the closing up of the annular gap 30.

Figure 8:
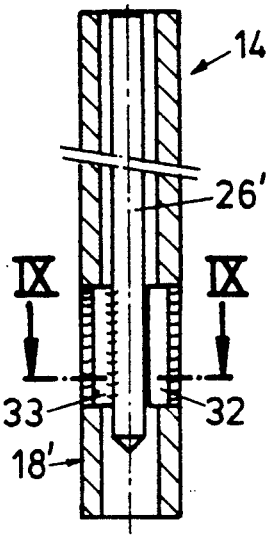
FIGS. 8 and 9 illustrate a further embodiment of the flushing means in the axial section and in the cross section along line IX—IX of FIG. 8, respectively.
Figure 6:
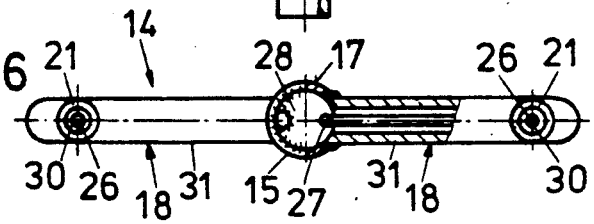
FIG. 6 illustrates the flushing means represented in FIG. 5 in the ground plan, also sectioned.
Figure 9:
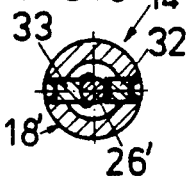

According to the embodiment illustrated in FIGS. 8 and 9, the flushing element is designed as a single element, i.e., as a single pipe 18' guided linearly from outside through the metal outer shell 1 and the whole refractory lining of the steelworks converter. Fixing of the insert 26' relative to the pipe 18' is effected by two radially symmetrically arranged ribs 32, 33. One of the ribs is fastened by welding to the pipe 18' only and serves to guide the insert 26'. The second rib 33, which is located on teh opposite side, is welded both to the pipe 18' and to the insert 26.

FIGS. 10 to 13 depict various cross sectional variants for the flushing arrangement of the invention. A square cross sectional pipe shape may prove particularly favorable if square recesses are cut into the bricks 6' of the working lining 7 such that one can do almost without any refractory mass at the fixations of the distributing pipes 18, 18' in the working lining 7. In the embodiment represented in FIG. 13, the insert 26 is formed by a multi-strand wire rope 34.

Due to the reliable prevention of the closing up of its mouth, the flushing arrangement according to the invention, ensures the feeding of flush gas at exactly predetermined amounts per time unit, a very precise control of the flush gas rate, thus, being possible. A particular advantage of the flushing arrangement according to the invention is to be seen in that its control may be facilitated by actuating several flushing arrangements by a commonly acting controlling organ. It is no longer necessary that each flushing arrangement be controllable separately because of the frequent obstructions of a conventional flushing arrangement. Thus, it is possible to connect several flushing arrangements to a common feeding pipe outside of the converter and to provide a controlling means at the same.

What I claim is:

1. In a flushing arrangement for a metallurgical vessel adapted to hold a molten metal bath, said vessel comprising a metal outer shell provided with a refractory lining formed of a permanent lining adjacent to the outer shell and a working lining adjacent to the permanent lining for confining said molten metal bath, said refractory lining being provided with a plurality of pipes passing therethrough at predetermined sites thereof through which flush gas is blown into the body of said molten metal bath, the improvement comprising:

a longitudinal insert passing through each of said pipes in the form of a wire or wire rope, said pipes characterized by either a circular cross section or a cross section in the shape of a regular polygon, said insert being fixed relative to said pipe to provide an annular gap and to provide a slight play in the axial direction internally of said pipe, each of said pipes having a predetermined internal diameter and a predetermined external diameter, the pipe portion in said working lining having a length such that the ratio of the length to the internal diameter of said pipe is at least about 16 to 1.

2. The flushing arrangement as set forth in claim 1, wherein said pipe portion located within the working lining and said wire or wire rope insert are disposed radially symmetrical one to the other.

3. The flushing arrangement as set forth in claim 1, wherein said pipe has square cross section.

4. The flushing arrangement as set forth in claim 1, wherein said pipe cross section is hexagonal.

5. The flushing arrangement as set forth in claim 1, wherein said annular gap has a width within said pipe ranging between about 1 and 3 mm.

6. The flushing arrangement as set forth in claim 1, wherein said pipe has an internal diameter ranging between about 4 and 12 mm and said insert has a diameter ranging between about 2 and 8 mm.

7. The flushing arrangement as set forth in claim 6, wherein said internal diameter of said pipe ranges between about 4 and 8 mm and said diameter of said insert ranges between about 2 and 5 mm.

8. The flushing arrangement as set forth in claim 1, wherein said pipe has an internal diameter and a wall thickness corresponding to approximately half of said internal diameter of said pipe.

9. The flushing arrangement as set forth in claim 1, further comprising a common gas feeding pipe adapted to be connected in a duct-like manner with at least two of said plurality of pipes arranged in said working lining of said metallurgical vessel at a distance from each other at their ends extending outside of said working lining adjacent to said permanent lining, each of said pipes having its insert fastened to said gas feeding pipe.

10. The flushing arrangement as set forth in claim 1, further comprising a common gas feeding pipe adapted to be connected in a duct-like manner with two of said plurality of pipes arranged in said working lining of said metallurgical vessel at a distance from each other with their ends located outside of the working lining, said two pipes having a common insert extending from the mouth of one of said two pipes to the mouth of the other of said two pipes.

11. The flushing arrangement as set forth in claim 1, wherein said pipe has a pipe portion extending outside of said working lining adjacent said permanent lining and said insert is fixed in an axial direction on said pipe portion located outside of the working lining.

12. The flushing arrangement as set forth in claim 11, further comprising at least one supporting rib for fixing said insert to said pipe portion located outside of the working lining.

13. The flushing arrangement as set forth in claim 1, wherein said pipe comprises a plurality of said inserts.

14. The flushing arrangement as set forth in claim 1, wherein said pipe has a pipe portion located within the working lining and a straight pipe portion extending at an angle to said pipe portion located within the working lining and passed by said insert.

15. The flushing arrangement as set forth in claim 1, wherein said working lining is comprised of refractory bricks with free spaces between said refractory lining and each of said pipes filled with a refractory mass.

16. In a flushing arrangement for a metallurgical vessel adapted to hold a molten metal bath, said vessel comprising a metal outer shell provided with a refractory lining formed of a permanent lining adjacent to the outer shell and a working lining adjacent to the permanent lining for confining said molten metal bath, said refractory lining being provided with a plurality of pipes passing therethrough at predetermined sites thereof through which flush gas is blown into the body of said molten metal bath, the improvement comprising:

a longitudinal insert passing through each of said pipes, said insert being an internal pipe fixed relative to each of said pipes as an external pipe, said internal pipe providing an annular gap and being adapted to provide slight play in the axial direction of said external pipe, each of said external pipes having a predetermined internal diameter and a predetermined external diameter, the external pipes portion in said working lining having a length such that the ratio of the length to the internal diameter of said pipe is at least about 16 to 1.

17. The flushing arrangement as set forth in claim 16, wherein said external pipe portion located within the working lining and said insert are disposed radially symmetrical one to the other.

18. The flushing arrangement as set forth in claim 16, wherein said external pipe has a square cross-section.

19. The flushing arrangement as set forth in claim 16, wherein said pipe cross section is hexagonal.

20. The flushing arrangement as set forth in claim 16, wherein said annular gap has a width within said external pipe ranging between about 1 and 3 mm.

21. The flushing arrangement as set forth in claim 16, wherein said external pipe has an internal diameter ranging between about 4 and 12 mm and said insert has a diameter ranging between about 2 and 8 mm.

22. The flushing arrangement as set forth in claim 21, wherein said internal diameter of said external pipe ranges between 4 and 8 mm and said diameter of said insert ranges between about 2 and 5 mm.

23. The flushing arrangement as set forth in claim 16, wherein said external pipe has an internal diameter and a wall thickness corresponding to approximately half of said internal diameter of said external pipe.

24. The flushing arrangement as set forth in claim 16, further comprising a common gas feeding pipe adapted to be connected in a duct-like manner with at least two of said plurality of pipes arranged in said working lining of said metallurgical vessel at a distance from each other at their ends extending outside of the working lining adjacent to said permanent lining, each of said external pipes having its insert fastened to said gas feeding pipe.

25. The flushing arrangement as set forth in claim 16, further comprising a common gas feeding pipe adapted to be connected in a duct-like manner with two of said plurality of external pipes arranged in said working lining of said metallurgical vessel at a distance from each other by their ends located outside of the working lining, said two external pipes having a common insert extending from the mouth of one of said two pipes to the mouth of the other of said two pipes.

26. The flushing arrangement as set forth in claim 16, wherein said external pipe has a pipe portion extending outside of the working lining and adjacent said permanent lining and said insert is fixed in the axial direction on said external pipe portion located outside of the working lining.

27. The flushing arrangement as set forth in claim 11, further comprising at least one supporting rib for fixing said insert to said external pipe portion located outside of the working lining.

28. The flushing arrangement as set forth in claim 16, wherein said external pipe has a pipe portion located within the working lining and a straight external pipe portion extending at an angle to said pipe portion located within the working lining and passed by said insert.

29. The flushing arrangement as set forth in claim 16, wherein said working lining is comprised of refractory bricks with free spaces between said refractory lining and each of said external pipes filled with a refractory mass.

* * * * *

UNITED STATES PATENT AND TRADEMARK OFFICE

CERTIFICATE OF CORRECTION

PATENT NO. : 5,076,551

DATED : December 31, 1991

INVENTOR(S) : Reinhard Kitzberger

It is certified that error appears in the above-identified patent and that said Letters Patent is hereby corrected as shown below:

Claim 16, column 8, after line 2, the following paragraph should be inserted:

--said pipes characterized by either a circular cross section or a cross section in the shape of a regular polygon, --.

Signed and Sealed this

Eighteenth Day of May, 1993

*Attest:*

Michael K. Kirk

MICHAEL K. KIRK

*Attesting Officer*

*Acting Commissioner of Patents and Trademarks*